US005953979A

United States Patent [19]

Eitai et al.

[11] Patent Number: 5,953,979

[45] Date of Patent: Sep. 21, 1999

[54] VARIABLE CAPACITY WOBBLE PLATE COMPRESSOR

[75] Inventors: Kazuo Eitai, Higashimatsuyama; Minoru Kanaizuka; Hiroyuki Ishida, both of Kounan-machi, all of Japan

[73] Assignee: Zexel Corporation, Tokyo, Japan

[21] Appl. No.: 09/018,095

[22] Filed: Feb. 3, 1998

[30] Foreign Application Priority Data

Feb. 10, 1997 [JP] Japan ..... 9-041609

[51] Int. Cl.[6] ..... F04B 1/12; F01B 3/00

[52] U.S. Cl. ..... 92/12.2; 92/57; 92/71; 417/269

[58] Field of Search ..... 92/12.2, 57, 71; 417/269; 60/487

[56] References Cited

U.S. PATENT DOCUMENTS 5,228,841 7/1993 Kimura et al. ..... 92/12.2 X
5,247,794 9/1993 Benson et al. ..... 60/487
5,370,505 12/1994 Takenaka et al. ..... 417/269

*Primary Examiner*—Hoang Nguyen

*Attorney, Agent, or Firm*—Frishauf, Holtz, Goodman, Langer & Chick

[57] ABSTRACT

A variable capacity wobble plate compressor includes a first spring, fitted on a drive shaft between a hinge ball axially slidably fitted on the drive shaft and a thrust flange rigidly fitted on the drive shaft, for urging the hinge ball toward a cylinder block, and a second spring fitted on the drive shaft between the hinge ball and the cylinder block for urging the hinge ball toward the thrust flange. As the hinge ball is moved toward the thrust flange, a linkage connecting a drive hub slidably mounted on the hinge ball a causes an inclination of the drive hub to be increased to increase capacity of the compressor, and as the hinge ball is moved toward the cylinder block, the linkage causes the inclination of the drive hub to be decreased to decrease the capacity of the compressor. A first stopper blocks the hinge ball from moving toward the thrust flange in excess of a predetermined amount, to thereby restrict an increase in the inclination of the drive hub and set the maximum capacity of the compressor. A second stopper blocks the hinge ball from moving toward the cylinder block in excess of a predetermined amount to thereby set the minimum capacity of the compressor.

17 Claims, 5 Drawing Sheets

VARIABLE CAPACITY WOBBLE PLATE COMPRESSOR

BACKGROUND OF THE INVENTION

1. Field of the Invention

This invention relates to a variable capacity wobble plate compressor in which the piston stroke length changes according to the inclination of a wobble plate.

2. Description of the Prior Art

FIGS. 1 and 2 show the whole arrangement of a conventional variable capacity wobble plate compressor. FIG. 1 shows the compressor in the full stroke condition, while FIG. 2 shows the compressor in the minimum stroke condition.

As shown in FIG. 1, the conventional variable capacity wobble plate compressor includes a thrust flange 140, a drive hub 141, a wobble plate 110, a coil spring 144 which functions as a destroke spring for decreasing the piston stroke length, and a coil spring 147 and a set of coned disk springs 146 which cooperate to function as a stroke spring for increasing the piston stroke length.

The thrust flange 140 is rigidly fitted on a drive shaft 105, for rotation in unison with the same.

The drive hub 141 is mounted on the drive shaft 105 via a hinge ball 109 axially slidably fitted on the drive shaft 105. Further, the drive hub 141 is tiltably connected to the thrust flange 140 via a linkage 142, for rotation in unison with the thrust flange 140.

The wobble plate 110 is slidably mounted on a boss of the drive hub 141, for performing wobbling motion as the drive hub 141 rotates. Further, the wobble plate 110 has each piston 107 connected thereto by a connecting rod 111, and the piston 107 reciprocates within a cylinder bore 106 associated therewith according to the axial wobbling motion of the wobble plate 110.

The coil spring 144 as a destroke spring is fitted on the drive shaft 105 between a front-side end of the hinge ball 109 and the boss of the thrust flange 140, for urging the hinge ball 109 in a direction of decreasing the inclination of the wobble plate 110 to thereby reduce the volume of a compression chamber within the cylinder bore 106.

The coil spring 147 and the set of coned disk springs 146 as the stroke spring are fitted on the drive shaft 105 in series between a rear-side end of the hinge ball 109 and a fixed washer 145 rigidly fitted on the drive shaft 105, for urging the hinge ball 109 in a direction of increasing the inclination of the wobble plate 110 to thereby increase the volume of the compression chamber within the cylinder bore 6.

In the variable capacity wobble plate compressor, as pressure within the crankcase 108 decreases, the inclination angle of the wobble plate 110 increases, so that an abutment portion 141*c* of the drive hub 141 abuts on a drive hub-receiving surface 140*c* (best shown in FIG. 2) formed on the thrust flange 140, as shown in FIG. 1. At this time, the coil spring 144 is contracted, whereas the coil spring 147 and the set of coned disk springs 146 are expanded, whereby the compressor is placed into the full stroke condition (the maximum delivery quantity condition in which the length of stroke of the piston 107 becomes the maximum).

On the other hand, as the pressure within the crankcase 108 increases, the inclination angle of the wobble plate 110 decreases, so that the abutment portion 141*c* of the drive hub 141 moves away from the drive hub-receiving surface 140*c* of the thrust flange 140 as shown in FIG. 2. At this time, the coil spring 144 is expanded, whereas the coil spring 147 and the set of coned disk springs 146 are contracted. When the axial length of the set of coned disk springs 146 becomes the minimum (i.e. the pitch becomes zero), the drive hub 141 stops tilting or rising toward the rear side of the compressor, whereby the compressor is placed into the minimum stroke condition (the minimum delivery quantity condition in which the length of stroke of the piston 107 becomes the minimum).

When the compressor is in the full stroke condition, however, the drive hub-receiving surface 140*c* of the thrust flange 140 has a reaction force of compression of the piston 107 applied thereto as long as the abutment portion 141*c* of the drive hub 141 and the drive hub-receiving surface 140*c* of the thrust flange 140 are in contact with each other after the abutment portion 141*c* abuts on the drive hub-receiving surface 140*c*, which causes slight vibrations of contact portions of the abutment portion 141*c* and the drive hub-receiving surface 140*c*. As a result, the vibrations can cause abrasion of the contact portions of the abutment portion 141*c* and the drive hub-receiving surface 140*c*.

Further, the reaction force of compression of the piston 107 applied to the drive hub-receiving surface 140*c* of the thrust flange 140 can deform the drive hub-receiving surface 140*c* or even cause breakage of the thrust flange 140 itself.

To prevent the above-mentioned abrasion, it is required to increase the hardness of the contact portions of the abutment portion 141*c* and the drive hub-receiving surface 140*c* e.g. by induction hardening. However, if this treatment is carried out, the number of man-hours as well as manufacturing costs of the compressor are increased.

Further, if the thrust flange 140 is reinforced so as to prevent deformation and breakage of the same, its dynamic balance is lost, which causes vibrations and untoward noises.

On the other hand, in the minimum stroke condition of the compressor, the inclination angle of the drive hub 141 becomes the minimum when the axial length of the set of coned disk springs 146 becomes the minimum to cause the set of coned disk springs 146 to exert its force as a stopper to the full. Therefore, bending stress of the coned disk springs 146 is extremely increased, which can cause breakage of the coned disk springs 146 or produce untoward noises.

SUMMARY OF THE INVENTION

It is a first object of the invention to provide a variable capacity wobble plate compressor having a construction which is capable of preventing abrasion, deformation, and breakage of a thrust flange without hardening the thrust flange e.g. by induction hardening or reinforcing the same.

It is a second object of the invention to provide a variable capacity wobble plate compressor having a construction which is capable of preventing breakage of a stroke spring and generation of untoward noises resulting from such breakage.

To attain the first object, according to a first aspect of the present invention, there is provided a variable capacity wobble plate compressor including a cylinder block, a plurality of cylinder bores formed through the cylinder block, a plurality of pistons slidably received in the cylinder bores, respectively, a drive shaft, a thrust flange rigidly fitted on the drive shaft, for rotation in unison with the drive shaft, a hinge ball axially slidably fitted on the drive shaft, a drive hub slidably mounted the hinge ball, a linkage connecting between the drive hub and the thrust flange in a manner such that the drive hub is axially tiltable about the hinge ball and rotatable in unison with the thrust flange, a wobble plate slidably mounted on the drive hub for performing wobbling motion as the drive hub rotates, to thereby change the length of stroke of each of the pistons, a first spring fitted on the drive shaft between the hinge ball and the thrust flange, for urging the hinge ball toward the cylinder block, and a second spring fitted on the drive shaft between the hinge ball and the cylinder block, for urging the hinge ball toward the thrust flange, wherein as the hinge ball is moved toward the thrust flange, the linkage causes an inclination of the drive hub to be increased to increase capacity of the compressor, and as the hinge ball is moved toward the cylinder block, the linkage causes the inclination of the drive hub to be decreased to decrease the capacity of the compressor, The variable capacity wobble plate compressor according to the first aspect of the invention is characterized by comprising a stopper for blocking the hinge ball from moving toward the thrust flange in excess of a predetermined extent, to thereby restrict an increase in the inclination of the drive hub to set the maximum capacity of the compressor.

According to this variable capacity wobble plate compressor, when the compressor enters the full stroke condition, the drive hub moves close to the thrust flange, whereby the second spring is expanded and the first spring is contracted. However, the stopper blocks the hinge ball on which the drive hub is slidably mounted from moving further toward the thrust flange, before the drive hub abuts on the thrust flange, to thereby restrict an increase in the inclination of the drive hub, so that the drive hub is prevented from being brought into abutment or contact against the thrust flange. Therefore, it is possible to prevent abrasion, deformation, and breakage of the thrust flange without hardening the thrust flange e.g. by induction hardening or reinforcing the same.

Preferably, the stopper comprises a hollow cylindrical member fitted on the drive shaft between the thrust flange and the hinge ball.

More preferably, the stopper has a flanged portion formed on an open end of the hollow cylindrical member, the flanged portion serving as a spring seat of the first spring.

According to this preferred embodiment, the first spring is prevented from directly abutting on the thrust flange, which makes it possible to eliminate the need for heat treatment of the thrust flange.

Further preferably, the first spring is a coil spring fitted on the drive shaft, the hollow cylindrical member being fitted on the drive shaft in a manner interposed between a peripheral surface of the drive shaft and the coil spring.

Still more preferably, the stopper has an axial length larger than a minimal axial length of the coil spring assumed when the coil spring is axially most contracted.

To attain the second object, the variable capacity wobble plate compressor according to a second aspect of the invention is characterized by comprising a stopper for blocking the hinge ball from moving toward the cylinder block in excess of a predetermined extent, to set the maximum capacity of the compressor.

According to this variable capacity wobble plate compressor, when the compressor enters the minimum stroke condition, the drive hub moves away from the thrust flange toward the cylinder block, whereby the first spring is expanded and the second spring is contracted. However, before the axial length of the second spring becomes the minimum, the stopper blocks the hinge ball from moving further toward the cylinder block, so that bending stress of the second spring does not become extremely large. As a result, it is possible to prevent breakage of the second spring (stroke spring) and generation of untoward noises resulting from such breakage.

Preferably, the stopper comprises a hollow cylindrical member fitted on the drive shaft between the cylinder block and the hinge ball.

More preferably, the stopper has a flanged portion formed on an open end of the hollow cylindrical member, the flanged portion serving as a spring seat of the second spring.

Further preferably, the second spring comprises a set of coned disk springs fitted on the drive shaft on a cylinder block side and a coil spring fitted on the drive shaft on a hinge ball side, the hollow cylindrical member being fitted on the drive shaft in a manner interposed between a peripheral surface of the drive shaft and the set of coned disk springs.

Still more preferably, the stopper has an axial length larger than a minimal axial length of the set of coned disk springs assumed when the set of coned disk springs are axially most contracted.

Still more preferably, the flanged portion is formed on an open end of the hollow cylindrical member on a coil spring side, thereby serving as a s the spring seat of the set of coned disk springs.

To attain the first and second objects, a variable capacity wobble plate compressor according to a third aspect of the invention is characterized by comprising:

a first stopper for blocking the hinge ball from moving toward the thrust flange in excess of a first predetermined extent, to thereby restrict an increase in the inclination of the drive hub to set the maximum capacity of the compressor; and a second stopper for blocking the hinge ball from moving toward the cylinder block in excess of a second predetermined extent, to set the minimum capacity of the compressor.

According to this variable capacity wobble plate compressor, when the compressor enters the full stroke condition, the drive hub moves close to the thrust flange, whereby the second spring is expanded and the first spring is contracted. However, the first stopper blocks the hinge ball on which the drive hub is slidably mounted from moving further toward the thrust flange, before the drive hub abuts on the thrust flange, to thereby restrict an increase in the inclination of the drive hub, so that the drive hub is prevented from being brought into abutment or contact against the thrust flange. As a result, it is possible to prevent abrasion, deformation, and breakage of the thrust flange without hardening the thrust flange e.g. by induction hardening or reinforcing the same. On the other hand, when the compressor enters the minimum stroke condition, the drive hub moves away from the thrust flange toward the cylinder block, whereby the first spring is expanded and the second spring is contracted. However, before the axial length of the second spring becomes the minimum, the second stopper blocks the hinge ball from moving further toward the cylinder block, so that bending stress of the second spring does not become extremely large. As a result, it is possible to prevent breakage of the second spring (stroke spring) and generation of untoward noises resulting from such breakage.

Preferably, the first stopper comprises a first hollow cylindrical member fitted on the drive shaft between the thrust flange and the hinge ball, and the second stopper comprises a second hollow cylindrical member fitted on the drive shaft between the cylinder block and the hinge ball.

More preferably, the first stopper has a first flanged portion formed on an open end of the hollow cylindrical member, the first flanged portion serving as a spring seat of the first spring, and the second stopper has a second flanged portion formed on an open end of the second hollow cylindrical member, the second flanged portion serving as a spring seat of the second spring.

Further preferably, the first spring is a first coil spring fitted on the drive shaft, the first hollow cylindrical member being fitted on the drive shaft in a manner interposed between a peripheral surface of the drive shaft and the first coil spring, and the second spring comprises a set of coned disk springs fitted on the drive shaft on a cylinder block side and a second coil spring fitted on the drive shaft on a hinge ball side, the second hollow cylindrical member being fitted on the drive shaft in a manner interposed between the peripheral surface of the drive shaft and the set of coned disk springs.

Still more preferably, the first stopper has an axial length larger than a minimal axial length of the first coil spring assumed when the first coil spring is axially most contracted, and the second stopper has a length larger than a minimal axial length of the set of coned disk springs assumed when the set of coned disk springs are axially most contracted.

Still more preferably, the second flanged portion is formed on an open and of the second hollow cylindrical member on a second coil spring side, thereby serving as a s the spring seat of the set of coned disk springs.

The above and other objects, features and advantages of the present invention will become more apparent from the following detailed description taken in conjunction with accompanying drawings.

DETAILED DESCRIPTION OF THE PREFERRED EMBODIMENT

The invention will now be described in detail with reference to drawings showing a preferred embodiment thereof.

Figure 1:
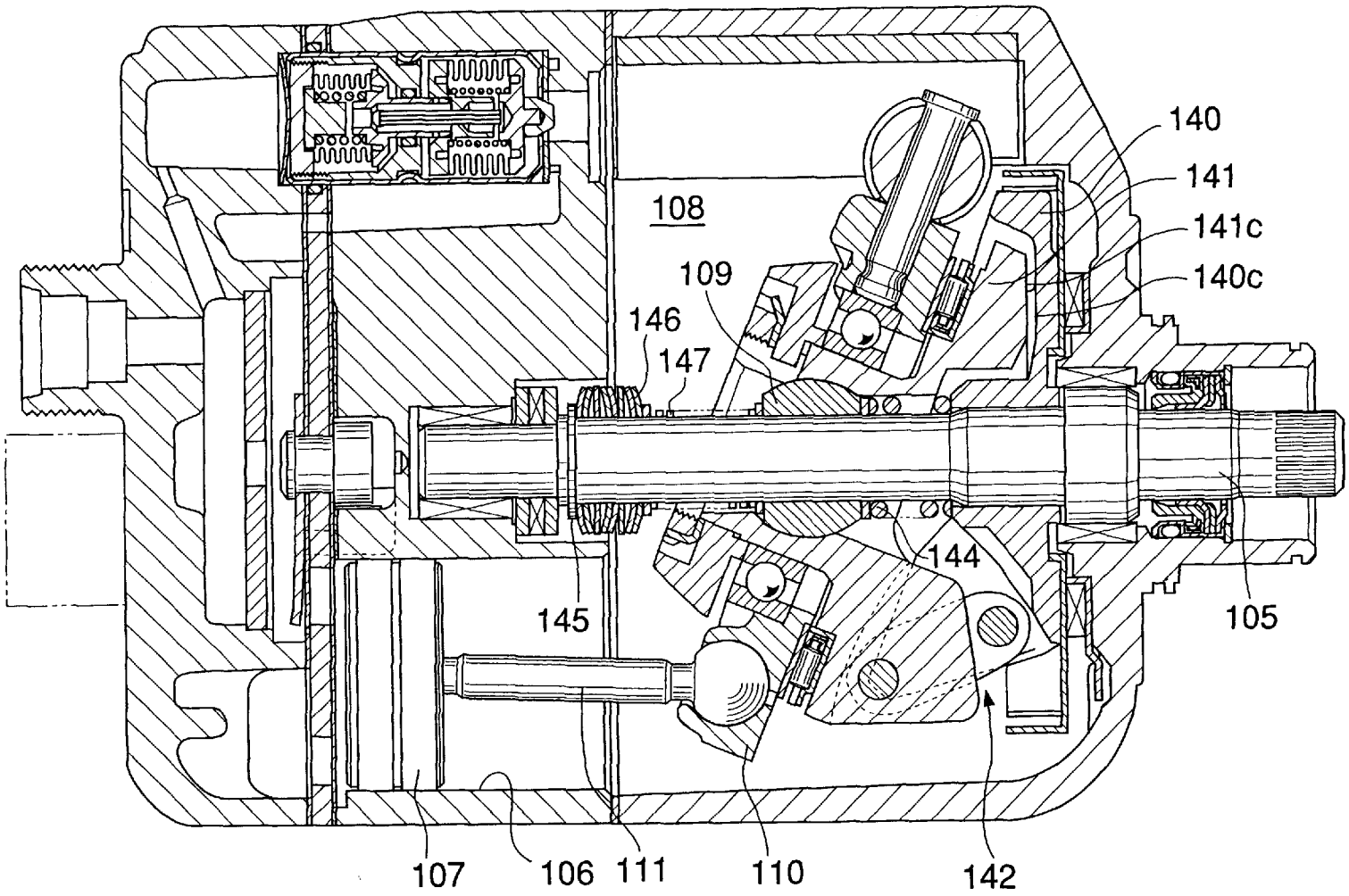
FIG.1 PRIOR ART
FIG. 1 is a cross-sectional view showing the whole arrangement of a conventional variable capacity wobble plate compressor in the full stroke condition.
Figure 2:
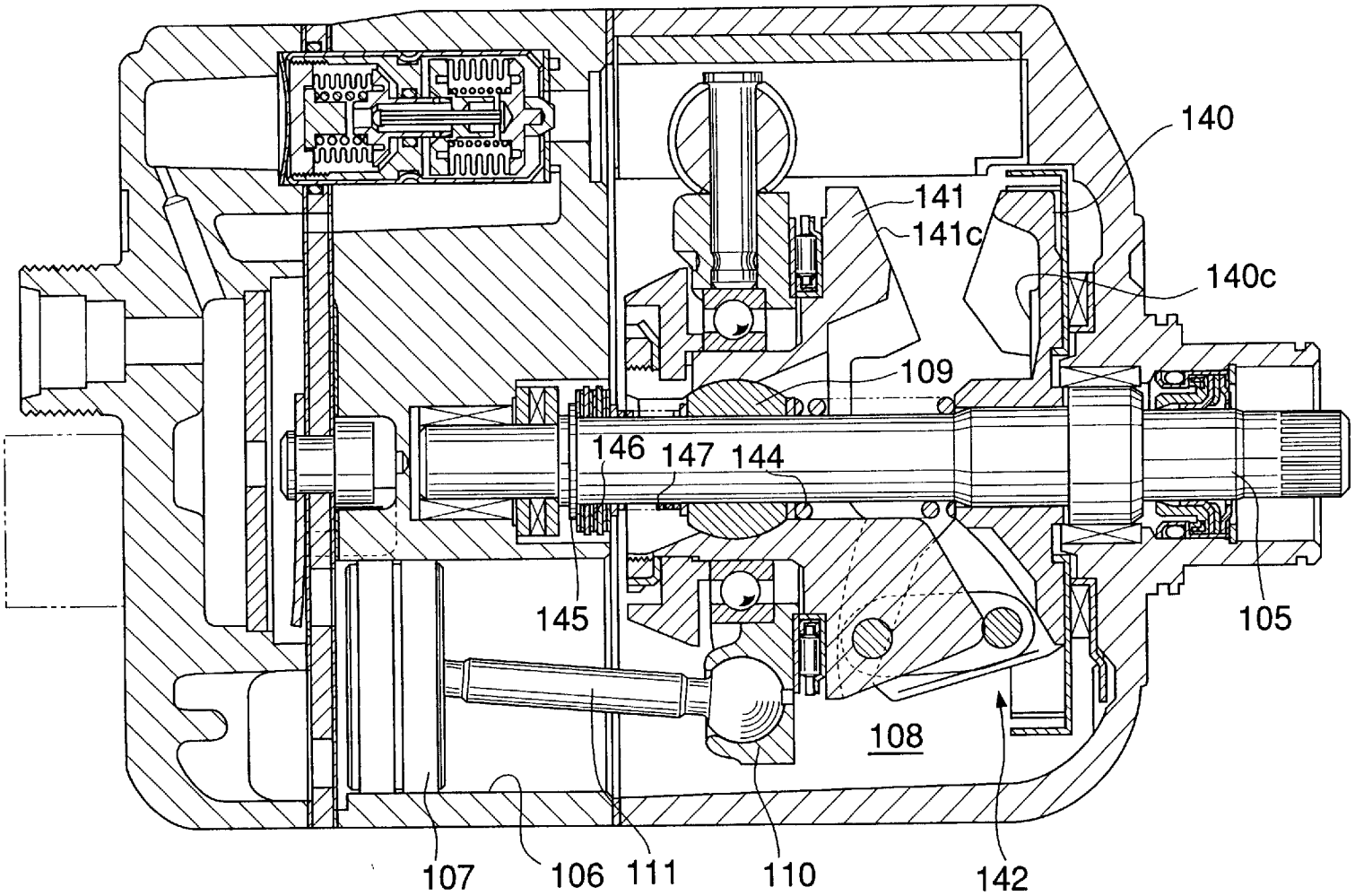
FIG.2 PRIOR ART
FIG. 2 is a cross-sectional view showing the whole arrangement of the conventional variable capacity wobble plate compressor in the minimum stroke condition.
Figure 3:
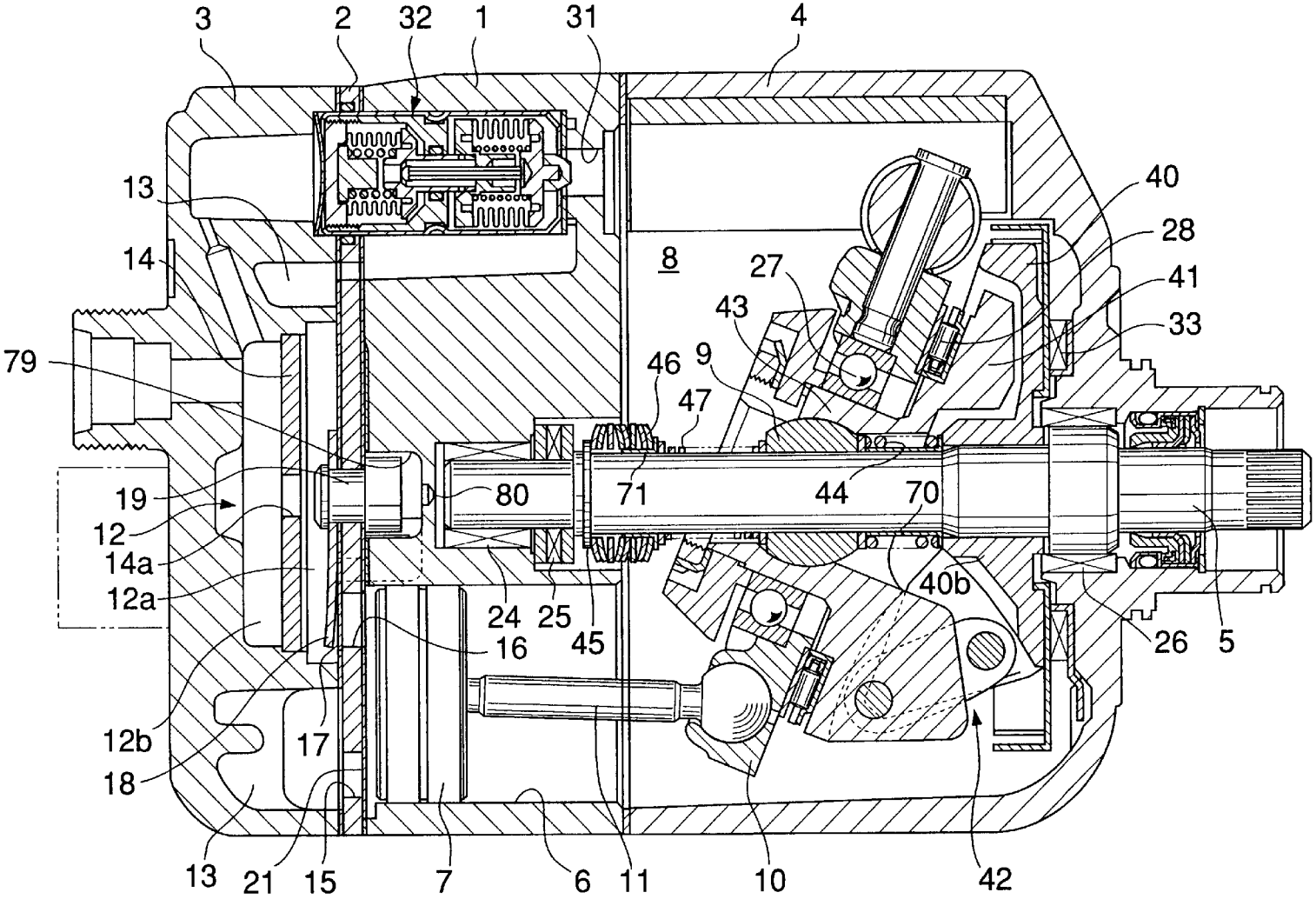
FIG. 3 is a cross-sectional view showing the whole arrangement of a variable capacity wobble plate compressor according to an embodiment of the invention, in the full stroke condition.
Figure 4:
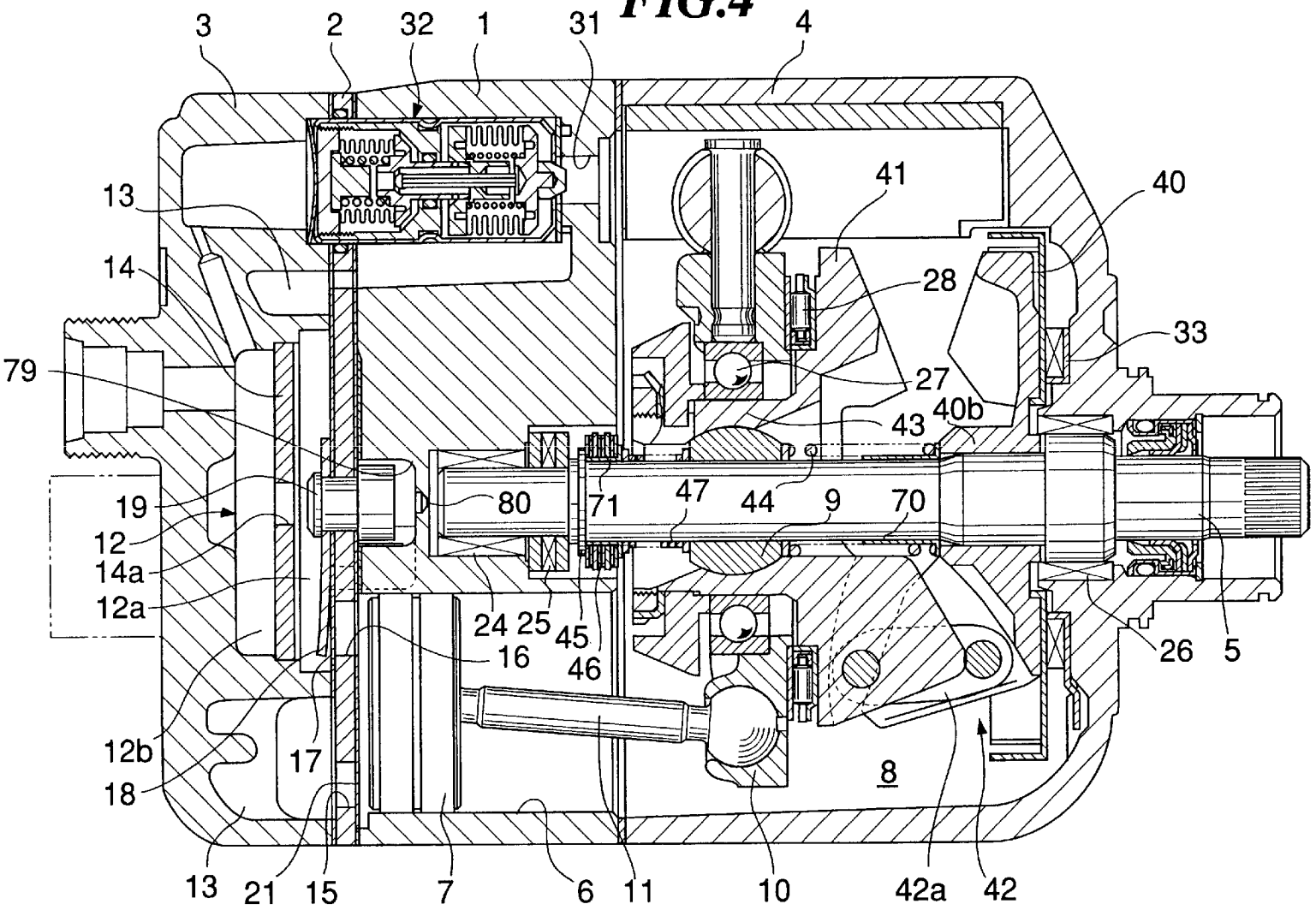
FIG. 4 is a cross-sectional view showing the whole arrangement of the variable capacity wobble plate compressor according to the embodiment of the invention, in the minimum stroke condition.
Figure 5:
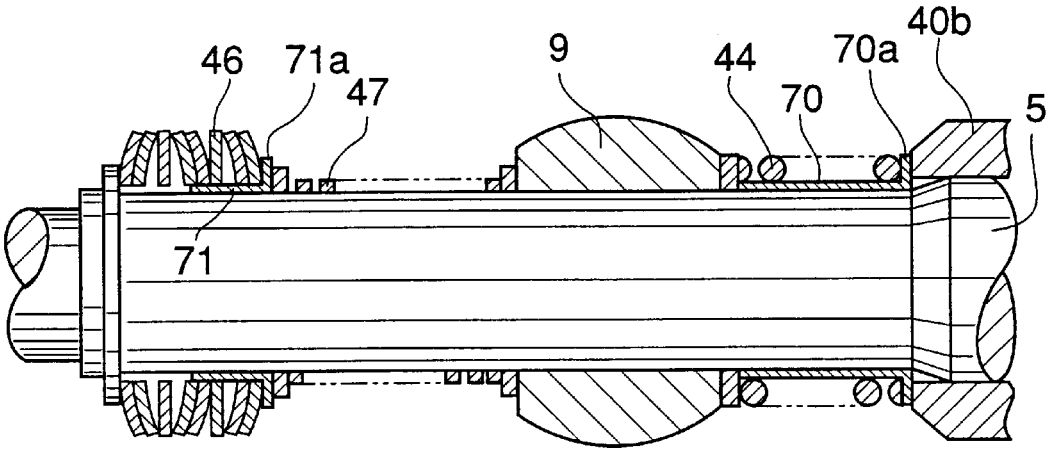
FIG. 5 is an enlarged view showing essential parts of the variable capacity wobble plate compressor in the FIG. 3 condition.
Figure 6:
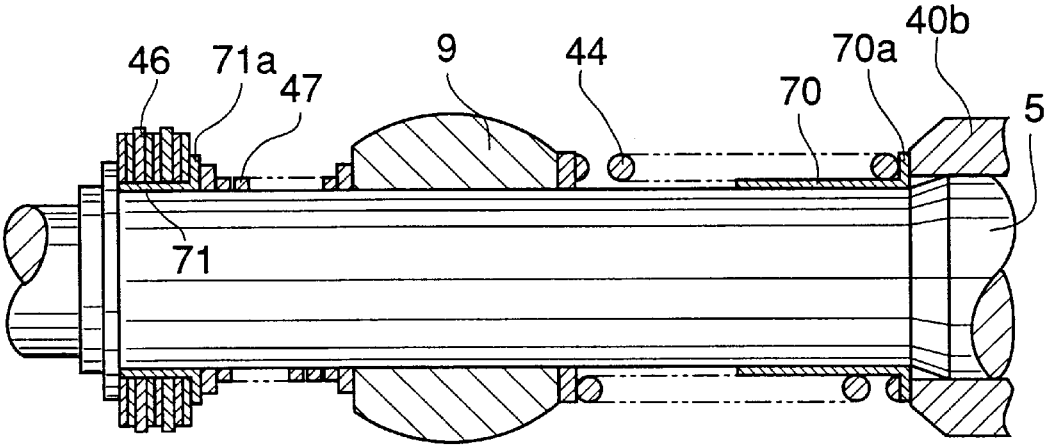
FIG. 6 is an enlarged view showing essential parts of the variable capacity wobble plate compressor in the FIG. 4 condition.

FIG. 3 shows the whole arrangement of a variable capacity wobble plate compressor according to an embodiment of the invention, in the full stroke condition, while FIG. 4 shows the whole arrangement of a variable capacity wobble plate compressor in the minimum stroke condition. FIG. 5 shows essential parts of the compressor in the FIG. 3 condition, on an enlarged scale, while FIG. 6 shows essential parts of the compressor in the FIG. 4 condition, on an enlarged scale.

The compressor includes a cylinder block 1, a rear head 3 secured to one and face of the cylinder block 1 via a valve plate 2, and a front head 4 secured to the other end face of the cylinder block 1.

The cylinder block 1 is formed with a plurality of cylinder bores 6 axially extending therethrough at predetermined circumferential intervals about a drive shaft 5. Each cylinder bore 6 has a piston 7 slidably received therein.

The front head 4 defines therein a crankcase 8 in which a wobble plate 10 is received for axial wobbling motion about a hinge ball 9 loosely or slidably fitted on the drive shaft 5, in a manner interlocked with rotation of the drive shaft 5.

The rear head 3 is formed therein with a discharge chamber 12 and a suction chamber 13 formed around the discharge chamber 12. The discharge chamber 12 is divided by a partition wall 14 into discharge spaces 12*a,* 12*b* which communicate with each other via a restriction hole 14*a* formed through the partition wall 14.

The valve plate 2 is formed therethrough with refrigerant outlet ports 16 for each communicating between a corresponding one of the cylinder bores 6 and the discharge space 12*a,* and refrigerant inlet ports 15 for each communicating between a corresponding one of the cylinder bores 6 with the suction chamber 13, at respective predetermined circumferential intervals. The refrigerant outlet ports 16 are opened and closed by respective discharge valves 17 formed as a unitary member fixed by a rivet 19 to a rear head-side and face of the valve plate 2 together with a valve stopper 18. On the other hand, the refrigerant inlet ports 15 are opened and closed by respective suction valves 21 formed as a unitary member arranged between the valve plate 2 and the cylinder block 1. The discharge space 12*a* within the discharge chamber 12 communicates with the crankcase 8 via a passage 79 and an orifice 80.

Further, the cylinder block 1 is formed therein with a communication passage 31 for communication between the suction chamber 13 and the crankcase 8. A pressure control valve 32 is arranged in an intermediate portion of the communication passage 31 for controlling the pressure within the suction chamber 13 and the pressure within the crankcase 8.

Further, a front-side end of the drive shaft 5 is rotatably supported by a radial bearing 26, while a rear-side end of the drive shaft 5 is rotatably supported by a radial bearing 24 and a thrust bearing 25. The drive shaft 5 has a thrust flange 40 rigidly fitted on a front-side portion thereof. At a location axially inward of the thrust flange 40, a drive hub 41 is slidably mounted on a hinge ball 9 which is axially slidably fitted on the drive shaft 5. The thrust flange 40 is supported on an inner wall of the front head 4 by a thrust bearing 33. A radially-outward portion of the thrust flange 40 and a radial end portion of the drive hub 41 are connected by a linking member 42*a* to form a linkage 42 which transmits torque of the drive shaft 5 from the thrust flange 40 to the drive hub 41 while permitting the drive hub 41 to axially tilt about the hinge ball 9. The wobble plate 10 is slidably mounted on the drive hub 41 via a radial bearing 27 and a thrust bearing 28, for performing wobbling motion. The wobble plate 10 has each piston 7 connected thereto by a connecting rod 11.

On the drive shaft 5 is fitted a coil spring (first spring) 44 as a destroke spring between the hinge ball 9 and a boss 40*b* of the thrust flange 40, for urging the hinge ball 9 toward the cylinder block 1 (i.e. in a direction of decreasing the inclination of the wobble plate 10 to thereby reduce the volume of a compression chamber within each cylinder bore 6). It should be noted that as the hinge ball 9 is moved toward the cylinder block 1, the inclination of the drive hub 41 slidably mounted on the hinge ball, and hence the inclination of the wobble plate 10, becomes smaller, since the radial end portion of the drive hub 41 is restricted in movement toward the cylinder block by the linkage 42 connecting between the radial end portion of the drive hub 41 and the radially outward portion of the thrust flange 40 at a position radially outward of the hinge ball 9, whereby the capacity or delivery quantity of the compressor is decreased.

On the other hand, a plurality of coned disk springs 46 and a coil spring 47 (second spring), which function as a stroke spring, are fitted on the drive shaft 5 in series between the hinge ball 9 and a fixed washer 45 rigidly fitted on a rear-side portion of the drive shaft 5 which extends within the cylinder block 1. The set of coned disk springs 46 and the coil spring 47 urge the hinge ball 9 toward the thrust flange 40 (i.e. in a direction of increasing the inclination of the wobble plate 10 to thereby increase the volume of the compression chamber). It should be noted that as the hinge ball 9 is moved toward the thrust flange 40, the inclination of the drive hub 41 slidably mounted on the hinge ball, and hence the inclination of the wobble plate 10, becomes larger, since the one radial end portion of the drive hub 41 is restricted in movement toward the thrust flange 40 by the linkage 42, whereby the capacity or delivery quantity of the compressor is increased.

A hollow cylindrical stopper (first stopper) 70 is axially slidably fitted on the drive shaft 5 in a manner interposed between the peripheral surface of the drive shaft 5 and the coil spring 44. As shown in FIG. 5, the stopper 70 has a front-side open end thereof formed with a flange 70*a* which serves as a spring seat. The stopper 70 has an axial length which is larger than the minimum axial length of the coil spring 44 (i.e. an axial length which the coil spring 44 has when its pitch becomes zero), and at the same time large enough to inhibit the drive hub 41 from tilting toward the front side of the compressor (i.e. in the direction of increasing the volume of the compression chamber) through a larger angle than required, to thereby hold the maximum piston stroke constant. The flange 70*a* of the stopper 70 prevents the coil spring 44 from abutting directly on the boss 40*b* of the thrust flange 40, which makes it possible to eliminate the need for hardening the boss 40*b*.

On the other hand, a hollow cylindrical stopper 71 is axially slidably fitted on the drive shaft 5 in a manner interposed between the peripheral surface of the drive shaft 5 and the set of coned disk springs 46. The stopper 71 has a front-side open end thereof formed with a flange 71*a* which serves as a spring seat. The stopper 71 has an axial length which is larger than the minimum axial length of the set of coned disk springs 46 (i.e. an axial length which the set of coned disk springs 46 has when its pitch becomes zero), and at the same time large enough to inhibit the drive hub 41 from tilting toward the rear side of the compressor (i.e. in the direction of decreasing the volume of the compression chamber) through a larger angle than required, to thereby hold the minimum piston stroke constant.

Next, the operation of the wobble plate compressor constructed as above will be described.

When torque of an engine, not shown, installed on an automotive vehicle, not shown, is transmitted to the drive shaft 5, the thrust flange 40 and the drive hub 41 rotate in unison with the drive shaft 5, whereby the wobble plate 10 performs axial wobbling motion about the hinge ball 9. The axial wobbling motion of the wobble plate 10 is transmitted to each piston 7 via its connecting rod 11 to cause reciprocating motion of the piston 7 within the cylinder bore 6 associated therewith which causes variation in the volume of the compression chamber within the cylinder bore 6. As the volume of the compression chamber varies, refrigerant gas is drawn in, compressed, and delivered sequentially. Thus, high-pressure refrigerant gas is delivered in a volume commensurate with the inclination angle of the wobble plate 10.

As thermal load decreases, the pressure control valve 32 closes the communication passage 31 to increase the pressure within the crankcase 8. As a result, the drive hub 41 moves away from the thrust flange 40 as shown in FIG. 4. At this time, the coil spring 44 is expanded, while the coil spring 47 and the set of coned disk springs 46 are contracted. According to the embodiment, however, since a rear-side open and of the stopper 71 abuts the fixed washer 45, the hinge ball 9 is inhibited from moving further toward the cylinder block 1 from a position where the inclination angle of the wobble plate 10 becomes the minimum before the axial length of the set of coned disk springs 46 becomes the minimum (i.e. its pitch becomes zero). As a result, the compressor enters the minimum stroke condition (minimum delivery quantity condition in which the length of stroke of the piston 7 becomes the minimum).

As thermal load increases, the pressure control valve 32 opens the communication passage 31 to decrease the pressure within the crankcase 8. As a result, the inclination angle of the wobble plate 10 becomes larger, which causes the coil spring 44 to contract, whereby the drive hub 41 moves closer to the thrust flange 40. According to the embodiment, however, since the hinge ball 9 abuts a rear-side open end of the stopper 70, the hinge ball 9 is blocked from moving further toward the thrust flange 40 to thereby stop the drive hub 41 from tilting or falling toward thrust flange 40 before the drive hub 41 abuts on the thrust flange 40. This position of the hinge ball 9 defines the maximum inclination angle of the wobble plate 10. Thus, the compressor enters the full stroke condition (maximum delivery quantity condition in which the length of stroke of the piston 7 becomes the maximum).

According to the variable capacity wobble plate compressor of the embodiment, since the drive hub 41 and the thrust flange 40 are not in contact with each other when the compressor is in the full stroke condition, partial wear of the thrust flange caused by contact with the drive hub 41 can be prevented, which makes it possible to eliminate the need for an operation such as induction hardening for the thrust flange 40 during the manufacturing process. As a result, man-hours are decreased, which contributes to reduction of manufacturing costs of the compressor. Moreover, since the drive hub 41 does not abut on the thrust flange 40 even when the compressor enters the full stroke condition, it is possible to prevent deformation and breakage of the thrust flange 40 without reinforcement of the same.

Further, since the tilting of the drive hub 41 is limited by the stopper 71 when the compressor is in the minimum stroke condition, it is possible to prevent bending stress of the set of coned disk springs 46 from becoming extremely large, and hence breakage of the coned disk springs 46 and generation of untoward noises resulting from such breakage can be avoided.

Although in the above embodiment, the hollow cylindrical stopper 70 as the first stopper is axially slidably fitted on the drive shaft 5 in a manner interposed between the peripheral surface of the drive shaft 5 and the coil spring 44, and the hollow cylindrical stopper 71 as the second stopper is axially slidably fitted on the drive shaft 5 in a manner interposed between the outer peripheral surface of the drive shaft 5 and the coned disk springs 46, this is not limitative, but a stopper, not shown, as the first stopper may be fixed to the boss 40*a* of the thrust flange 40 or the front-side end face of the hinge ball 9, and another stopper, not shown, as the second stopper, may be fixed to the fixed washer 45 or the rear-side end face of the hinge ball 9.

It is further understood by those skilled in the art that the foregoing is the preferred embodiment of the invention, and that various changes and modification may be made without departing from the spirit and scope thereof.

What is claimed is:

1. In a variable capacity wobble plate compressor including a cylinder block, a plurality of cylinder bores formed through said cylinder block, a plurality of pistons slidably received in said cylinder bores, respectively, a drive shaft, a thrust flange rigidly fitted on said drive shaft, for rotation in unison with said drive shaft, a hinge ball axially slidably fitted on said drive shaft, a drive hub slidably mounted said hinge ball, a linkage connecting between said drive hub and said thrust flange in a manner such that said drive hub is axially tiltable about said hinge ball and rotatable in unison with said thrust flange, a wobble plate slidably mounted on said drive hub for performing wobbling motion as said drive hub rotates, to thereby change the length of stroke of each of said pistons, a first spring fitted on said drive shaft between said hinge ball and said thrust flange, for urging said hinge ball toward said cylinder block, and a second spring fitted on said drive shaft between said hinge ball and said cylinder block, for urging said hinge ball toward said thrust flange, wherein as said hinge ball is moved toward said thrust flange, said linkage causes an inclination of said drive hub to be increased to increase capacity of said compressor, and as said hinge ball is moved toward said cylinder block, said linkage causes said inclination of said drive hub to be decreased to decrease said capacity of said compressor, the improvement comprising a stopper for blocking said hinge ball from moving toward said thrust flange in excess of a predetermined extent, to thereby restrict an increase in said inclination of said drive hub to set the maximum capacity of said compressor.

2. A variable capacity wobble plate compressor according to claim 1, wherein said stopper comprises a hollow cylindrical member fitted on said drive shaft between said thrust flange and said hinge ball.

3. A variable capacity wobble plate compressor according to claim 2, wherein said stopper has a flanged portion formed on an open end of said hollow cylindrical member, said flanged portion serving as a spring seat of said first spring.

4. A variable capacity wobble plate compressor according to claim 3, wherein said first spring is a coil spring fitted on said drive shaft, said hollow cylindrical member being fitted on said drive shaft in a manner interposed between a peripheral surface of said drive shaft and said coil spring.

5. A variable capacity wobble plate compressor according to claim 4, wherein said stopper has an axial length larger than a minimal axial length of said coil spring assumed when said coil spring is axially most contracted.

6. In a variable capacity wobble plate compressor including a cylinder block, a plurality of cylinder bores formed through said cylinder block, a plurality of pistons slidably received in said cylinder bores, respectively, a drive shaft, a thrust flange rigidly fitted on said drive shaft, for rotation in unison with said drive shaft, a hinge ball axially slidably fitted on said drive shaft, a drive hub slidably mounted said hinge ball, a linkage connecting between said drive hub and said thrust flange in a manner such that said drive hub is axially tiltable about said hinge ball and rotatable in unison with said thrust flange, a wobble plate slidably mounted on said drive hub for performing wobbling motion as said drive hub rotates, to thereby change the length of stroke of each of said pistons, a first spring fitted on said drive shaft between said hinge ball and said thrust flange, for urging said hinge ball toward said cylinder block, and a second spring fitted on said drive shaft between said hinge ball and said cylinder block, for urging said hinge ball toward said thrust flange, wherein as said hinge ball is moved toward said thrust flange, said linkage causes an inclination of said drive hub to be increased to increase capacity of said compressor, and as said hinge ball is moved toward said cylinder block, said linkage causes said inclination of said drive hub to be decreases to decrease said capacity of said compressor, the improvement comprising a stopper for blocking said hinge ball from moving toward said cylinder block in excess of a predetermined extent, to set the minimum capacity of said compressor.

7. A variable capacity wobble plate compressor according to claim 6, wherein said stopper comprises a hollow cylindrical member fitted on said drive shaft between said cylinder block and said hinge ball.

8. A variable capacity wobble plate compressor according to claim 7, wherein said stopper has a flanged portion formed on an open end of said hollow cylindrical member, said flanged portion serving as a spring seat of said second spring.

9. A variable capacity wobble plate compressor according to claim 8, wherein said second spring comprises a set of coned disk springs fitted on said drive shaft on a cylinder block side and a coil spring fitted on said drive shaft on a hinge ball side, said hollow cylindrical member being fitted on said drive shaft in a manner interposed between a peripheral surface of said drive shaft and said set of coned disk springs.

10. A variable capacity wobble plate compressor according to claim 9, wherein said stopper has an axial length larger than a minimal axial length of said set of coned disk springs assumed when said set of coned disk springs are axially most contracted.

11. A variable capacity wobble plate compressor according to claim 9, wherein said flanged portion is formed on an open end of said hollow cylindrical member on a coil spring side, thereby serving as a s said spring seat of said set of coned disk springs.

12. In a variable capacity wobble plate compressor including a cylinder block, a plurality of cylinder bores formed through said cylinder block, a plurality of pistons slidably received in said cylinder bores, respectively, a drive shaft, a thrust flange rigidly fitted on said drive shaft, for rotation in unison with said drive shaft, a hinge ball axially slidably fitted on said drive shaft, a drive hub slidably mounted said hinge ball, a linkage connecting between said drive hub and said thrust flange in a manner such that said drive hub is axially tiltable about said hinge ball and rotatable in unison with said thrust flange, a wobble plate slidably mounted on said drive hub for performing wobbling motion as said drive hub rotates, to thereby change the length of stroke of each of said pistons, a first spring fitted on said drive shaft between said hinge ball and said thrust flange, for urging said hinge ball toward said cylinder block, and a second spring fitted on said drive shaft between said hinge ball and said cylinder block, for urging said hinge ball toward said thrust flange, wherein as said hinge ball is moved toward said thrust flange, said linkage causes an inclination of said drive hub to be increased to increase capacity of said compressor, and as said hinge ball is moved toward said cylinder block, said linkage causes said inclination of said drive hub to be decreased to decrease said capacity of said compressor, the improvement comprising:

a first stopper for blocking said hinge ball from moving toward said thrust flange in excess of a first predetermined extent, to thereby restrict an increase in said inclination of said drive hub to set the maximum capacity of said compressor; and a second stopper for blocking said hinge ball from moving toward said cylinder block in excess of a second predetermined extent, to set the minimum capacity of said compressor.

13. A variable capacity wobble plate compressor according to claim 12, wherein said first stopper comprises a first hollow cylindrical member fitted on said drive shaft between said thrust flange and said hinge ball, and wherein said second stopper comprises a second hollow cylindrical member fitted on said drive shaft between said cylinder block and said hinge ball.

14. A variable capacity wobble plate compressor according to claim 13, wherein said first stopper has a first flanged portion formed on an open end of said hollow cylindrical member, said first flanged portion serving as a spring seat of said first spring, and said second stopper has a second flanged portion formed on an open end of said second hollow cylindrical member, said second flanged portion serving as a spring seat of said second spring.

15. A variable capacity wobble plate compressor according to claim 14, wherein said first spring is a first coil spring fitted on said drive shaft, said first hollow cylindrical member being fitted on said drive shaft in a manner interposed between a peripheral surface of said drive shaft and said first coil spring, and wherein said second spring comprises a set of coned disk springs fitted on said drive shaft on a cylinder block side and a second coil spring fitted on said drive shaft on a hinge ball side, said second hollow cylindrical member being fitted on said drive shaft in a manner interposed between said peripheral surface of said drive shaft and said set of coned disk springs.

16. A variable capacity wobble plate compressor according to claim 15, wherein said first stopper has an axial length larger than a minimal axial length of said first coil spring assumed when said first coil spring is axially most contracted, and wherein said second stopper has an axial length larger than a minimal axial length of said set of coned disk springs assumed when said set of coned disk springs are axially most contracted.

17. A variable capacity wobble plate compressor according to claim 15, wherein said second flanged portion is formed on an open end of said second hollow cylindrical member on a second coil spring side, thereby serving as a s said spring seat of said set of coned disk springs.

* * * * *